US005814241A

United States Patent [19]

Reutova et al.

[11] Patent Number: 5,814,241

[45] Date of Patent: Sep. 29, 1998

[54] NON-VAPORIZING GETTER AND METHOD OF OBTAINING THE SAME

[75] Inventors: Nina Pavlovna Reutova; Sergei Jurievich Manegin; Jury Mikhailovich Pustovoit; Vladimir Leonidovich Stolyarov, all of Moscow, Russian Federation

[73] Assignee: Tovarischetstvo S Organichennoi Otvetstvennostju "Tekhnovakt"

[21] Appl. No.: 868,232

[22] Filed: Jun. 3, 1997

[51] Int. Cl.[6] ..... H01J 7/18; B22F 1/00

[52] U.S. Cl. ..... 232/181.1; 252/181.6

[58] Field of Search ..... 252/181.1, 181.6; 75/228

[56] References Cited

U.S. PATENT DOCUMENTS 4,079,523 3/1978 Sandrock ..... 34/15

FOREIGN PATENT DOCUMENTS

| | | |
|---|---|---|
| 2370101 | 6/1978 | France . |
| 3031471 | 11/1985 | Germany . |
| 1750258 | 7/1994 | Russian Federation . |
| 2034084 | 4/1995 | Russian Federation . |
| 1548581 | 7/1978 | United Kingdom . |
| 2161182 | 1/1986 | United Kingdom . |

*Primary Examiner*—Shean C. Wu

*Attorney, Agent, or Firm*—Seidel, Gonda, Lavorgna & Monaco, PC

[57] ABSTRACT

A nonevaporable getter having an improved sorptive capacity is prepared from a metal powder comprising a titanium-vanadium alloy containing from 20 to 35% by weight vanadium, from 0.1% to 0.5% by weight calcium, the balance being titanium. The metal powder has a bulk density in the range from about 0.7 to about 1.5 g/cm$^3$. A getter prepared from this metal powder comprises from 20 to 35% by weight vanadium, from 0.1 to 0.5% by weight calcium, and the balance being titanium. A getter prepared from this metal powder has a porosity from 25 to 65% by volume. A method for the preparation of a getter is also provided.

6 Claims, No Drawings

NON-VAPORIZING GETTER AND METHOD OF OBTAINING THE SAME

FIELD OF TECHNOLOGY

The present invention relates to vacuum techniques, specifically to nonevaporable getter and a process for its production.

The invention may be used as a pump for creating and maintaining high vacuum in electronic vacuum devices, e.g., in a cathode-ray tube; in an optical converter, gyroscope, or the like; or in elementary particle sources and accelerators, e.g., in a thermonuclear plant of the TOKAMAK T-15 type.

Preferably, the present invention may be used for creating a vacuum in devices reducing heat transfer from the environment to thermostated media, e.g. in vacuum flasks, liquified gas storage applications, and in pipelines for gas and crude oil transportation from wells, wherein the pipelines are thermally insulated to protect from the environment in the permafrost zone.

Also, the present invention may be successfully used for the purification of inert gases.

PRIOR ART

Presently intensive development of novel technologies in, e.g., semiconductor production and use, is setting stringent requirements for stability of n-type and p-type conduction in p-n-junctions. Such conduction is disturbed by detrimental gaseous impurities (i.e., $O_2$, CO, $CO_2$, $H_2O$, $N_2$, and the like) present in the treatment zone of semiconductors. The detrimental impurities are removed by pumping them out from the treatment zone using sorption pumps based on nonevaporable getters. The decrease in the concentration level of detrimental gaseous impurities in the treatment zone depends on the sorption rate of the impurities. Therefore, the development of getters having improved sorption rate is a matter of great importance.

An attempt was made to produce a getter having increased sorption rate (the USSR Inventor's Certificate No. 1715496). A getter has three layers: a supporting layer, made of a plastic material selected from a group comprising, e.g., Fe, Ni or their alloys, and two other surface getter layers each made of a zirconium-based material containing, e.g., 16% by weight of aluminum (and the balance being zirconium) or 30% by weight of vanadium, 20% by weight of titanium, and the balance being zirconium.

A known process for producing a getter based on zirconium, comprises the following operations:

simultaneous feeding into a deformation zone a powder material forming a supporting layer (selected from, e.g., a group comprising Fe, Ni or the alloys thereof) and a zirconium-based powder material forming a getter layer. The zirconium-based powder material comprises 16% by weight of aluminum (Al), the balance being zirconium (Zr), or 30% by weight of vanadium (V), 20% by weight of titanium (Ti), the balance being zirconium (Zr). Zirconium-based materials are fed on both sides of the material forming the supporting layer. In the deformation zone the powder materials are formed by rolling, as a result of which a getter blank in the form of a three-layer ribbon is produced. When the ribbon is leaving the deformation zone it is cut into standard sections, e.g. 200 mm. Said standard sections of getter blanks are brought into a heating zone wherein vacuum conditions are created and maintained, and heated up to 950–1,000 degrees Celsius. As a result, the blank material gets sintered and the final getter is produced in the form of a product having improved mechanical properties, namely, increased tensile strength of getter material, e.g. from 6.3 to 6.8 $kg/mm^2$. Sorption rates are also increased, reaching 1.9 $m^3/m^2 \cdot s$ at room temperature, when the sorbed hydrogen quantity is 1.3 $m^3$ Pa/kg, after getter activation at 900 Celsius degrees.

In spite of increased tensile strength, the known getter shows low mechanical strength of the getter layer because getter layers are made of a material based on Zr-Al or Zr-V-Ti alloys comprising a large amount of intermetallic compounds characterized by increased hardness and brittleness. Therefore, when such getters are used under alternating loads, they fail, most often as a result of crumbling. Moreover, zirconium-based getter containing 16% by weight of aluminium causes increased power consumption because high temperature (about 900 degrees Celsius) is required to activate such getter.

Furthermore, the known getter has low sorptive capacity with respect to such gases as $H_2$, $O_2$, $CO_2$, CO, $N_2$, and the like because the supporting layer made of, e.g. Fe, Ni and their alloys, is neutral to gas sorption, and because the porosity of getter layers is low, being about 20%.

The above process for producing nonevaporable getter is hard to realize because it is difficult to reach an optimal correlation between the thickness of the supporting layer and the total thickness of the getter layer. Also, said process described involves high losses of powder material, resulting in increased getter costs.

Also known is a nonevaporable getter having increased mechanical strength and improved sorption rate (the RF Patent No. 1750256). This known getter contains from 20 to 35% by weight of vanadium (V), from 0.1 to 0.5% by weight of calcium (Ca), and the balance being titanium (Ti).

Said getter shows increased mechanical strength when used under alternating loads, due to the high plasticity of the material, which is a solid solution of vanadium in titanium. The presence of elemental calcium in the getter material contributes to an increased rate of gas sorption because calcium, with a high chemical activity to oxygen, forms calcium oxide (CaO). Calcium oxide particles, uniformly distributed among metal particles act as antisintering agents contributing to the high porosity of the getter.

The above getter is produced as follows: Metal powder containing from 20 to 35% by weight of vanadium, from 0.1 to 0.5% by weight of calcium, and the balance being titanium, is fed into a deformation zone. The powder material is formed by rolling to produce a getter blank in the form of a ribbon. As the ribbon leaves the deformation zone, it is cut into standard sections, the sections then transported into a heating zone.

In the heating zone a pressure lower than 1 Pa is created and maintained. The blank is heated to a temperature lower than 0.6 times the melting point of titanium-vanadium alloy, e.g. to 850 degrees Celsius, with further holding. The getter thus produced is a plate having 22% porosity and a sorption rate with respect to hydrogen of 1.8 $m^3/m^2s$ at room temperature, when the quantity of sorbed hydrogen is 1.3 $m^3$ Pa/kg. Said getter is activated at 300–350 degrees Celsius.

In view of the foregoing a getter having said composition, may be referred to the getters with low activation temperature, which fact allows to develop pumping means requiring low power consumption. Nevertheless, due to a reduced sorption rate, such getter has restricted applicability, e.g. it cannot be used as a stage in a multistage pumping device used in semiconductor production.

DESCRIPTION OF THE INVENTION

The object of the present invention is to develop a nonevaporable getter having a sorptive rate with respect to hydrogen of over 2 $m^3/m^2s$ at room temperature when the quantity of sorbed hydrogen is 1.3 $m^3Pa/kg$, due to a larger surface contacting the gas to be pumped out.

The object of the invention is achieved by a nonevaporable getter containing from 20 to 35% by weight of vanadium, from 0.1 to 0.5% by weight of calcium and the balance being titanium, having a porosity from 25 to 65% by volume.

Said getter has a larger number of pore openings at its surface. As a result, a larger surface contacts the gas to be pumped out, resulting in an increased gas sorption rate, e.g. the sorption rate for hydrogen is over 2 $m^3/m^2 \cdot s$ at room temperature when the quantity of sorbed hydrogen is 1.3 $m^3$ Pa/kg. A getter having a porosity less than 25% shows hydrogen sorption rates less than 2 $m^3/m^2 \cdot s$, thus restricting its applicability. For example, a getter having porosity less than 25% cannot be used as a stage in a multistage pumping device used in semiconductors production.

A getter having porosity over 65% has lower mechanical strength, which may result in its crumbling and failing under alternating loads. Such getter cannot be used, e.g., in night-vision devices, gyroscopes, and the like.

Thus, the getter according to the present invention has an increased sorption rate (1.5–3 times greater) after activation at 300–350 degrees Celsius, due to greater open porosity accounting for increasing total porosity of the getter.

It is also the object of the invention to develop a process for producing a nonevaporable getter comprising the use of powder material with branched particles to form porosity in the range from 25 to 65% in said material.

The object of the invention is achieved by a process for producing a nonevaporable getter comprising feeding a metal powder containing from 20 to 35% by weight of vanadium, from 0.1 to 0.5% by weight of calcium, the balance being titanium, into a deformation zone. The powder material is formed by rolling to produce a getter blank in the form of a ribbon. When leaving the deformation zone, the ribbon is cut into standard sections, with the sections then transported into a heating zone. A pressure of lower than 1 Pa is created and maintained in the heating zone. The blank is heated to a temperature lower than 0.6 times the melting point of titanium-vanadium alloy, with further holding, producing a getter having a porosity from 25% to 65% by volume. According to the invention, the metal powder has bulk density in the range from about 0.7 to about 1.5 $g/cm^3$.

Bulk density of a metal powder determines the pores' quantity and size in the formed blank. It is generally known that with lower bulk density values, greater values of porosity of the final product are obtained, and vice versa.

Experiments have shown that when a metal powder containing from 20 to 35% by weight of vanadium, from 0.1 to 0.5% by weight of calcium, the balance being titanium, has a bulk density approaching the value of 0.7 $g/cm^3$, then resulting getter has porosity of about 65%. When bulk density of the above powder is about 1.5 $g/cm^3$, then the resulting getter has a porosity of about 25%.

Preferably, the metal powder fed into the deformation zone should contain less than 70% by weight, a fraction having a particle size of less than 50 $\mu$m. The metal powder will then have a bulk density of about 1.5 $g/cm^3$. In the case above, wherein metal powder contains less than 20% by weight of a fraction having a particle size of less than 50 $\mu$m, bulk density of said powder will be about 0.7 $g/cm^3$.

Preferably, getter blank should be heated within the range from about 750 to about 950 degrees Celsius. This temperature range is determined by the maximum permissible shrinkage level with which the mechanical strength of resulting getter, as well as its porosity (25–65%), are maintained. When the blank is heated up to less than 750 degrees Celsius in the heating zone, then weaker bonds are formed among the particles, due to low diffusive mobility of metal atoms. This results in reduced mechanical strength of the getter. When the blank is heated up to over 950 degrees Celsius, considerable shrinkage occurs which causes reduced porosity of the getter, thus resulting in a lower sorption rate.

When the porosity of a getter blank is less than 45%, a standard section of the blank may be coiled.

It is known that a ribbon-type blank shows low mechanical strength, which strength reduces when porosity increases. Experiments have shown that when getter blank having porosity over 45% is coiled, the blank fails.

Other objects and advantages of the invention will be clarified by the following examples of specific embodiments of the present invention.

VARIANTS OF SPECIFIC EMBODIMENTS OF THE INVENTION

A nonevaporable getter according to the invention contains from 20 to 35% by weight of vanadium, from 0.1 to 0.5% by weight of calcium, the balance being titanium, and has a porosity from about 25% to about 65% (by volume).

The getter according to the invention has a hydrogen sorption rate over 2 $m^3/m^2 \cdot s$ at room temperature, when the quantity of sorbed hydrogen is 1.3 $m^3$ Pa/kg, with the getter being activated at from 300 to 350 degrees Celsius.

These properties allow the use of the getter in sorption pumps used in elementary particle sources and accelerators, e.g. in thermonuclear plants wherein a high pumping rate is to be provided in restricted spaces.

To produce a getter having the abovementioned properties, a process is provided according to the invention, said process comprising the following operations:

Metal powder containing from 20 to 35% by weight of vanadium, from 0.1 to 0.5% by weight of calcium, the balance being titanium, and having bulk density within the range from about 0.7 to about 1.5 $g/cm^3$ is fed into a deformation zone. Said metal powder contains less than 70% (by weight) of fraction having particle size of less than 50 $\mu$m. Within the deformation zone a force is exerted, e.g. 1 $t/cm^2$, exceeding the compression strength of the metal powder and causing plastic deformation of metal particles.

Further, metal powder is rolled to form a ribbon blank having uniform density and higher porosity than the porosity of the final product. The ribbon's length is much longer than its width. The ribbon has small thickness and a strength sufficient to transport the ribbon into a heating zone. As a result of the rolling, a ribbon is produced having a width from 15 to 80 mm, and a thickness from 0.4 to 0.8 mm.

During rolling, the metal powder undergoes continuous forming. This reduces the volume of the powder because the density of particles placement in the powder increases, though the weight remains constant.

As a getter blank leaves the deformation zone, it is cut into standard sections. The sections have lengths of 200, 70 mm, etc. and are transported into a heating zone. In the heating zone, a pressure below 1 Pa is created and maintained, under which the partial pressure of chemically active gases (excluding hydrogen) should be below $1.10^{-2}$ Pa in the heating zone. The getter blank is heated to a temperature lower than 0.6 times the melting point of titanium-vanadium alloy, followed by holding. The heating temperature is maintained in the range from about 750 to about 950 degrees Celsius. Said temperature range is determined by the maximum permissible shrinkage level at which the mechanical strength of resulting getter is maintained, namely, a tensile strength reaching, e.g., from 1 to 6 kg/mm$^2$ and the desired porosity is from 25 to 65%.

In one variant of specific embodiments of the invention, a standard section of said getter blank is coiled, provided that getter porosity is below 45%. It is known that a ribbon-type blank shows low mechanical strength, which strength decreases when the porosity increases. Experiments have shown that when a blank having porosity over 45% is coiled, said blank fails.

EXAMPLE 1

Metal powder containing 28.45% by weight of vanadium, 0.31% by weight of calcium, 71.24% by weight of titanium, and having a bulk density $\gamma$=1.17 g/cm$^3$ is fed into the deformation zone. The metal powder contains 57% (by weight) fraction (q) having particle size less than 50 $\mu$m. Within the deformation zone, metal powder is formed by rolling using rollers having a diameter ($\phi$) (of e.g. 100 mm, and a rolling speed (V) of 1.5 m/min. As a result, a getter blank of uniform density is produced in the form of a ribbon having thickness (h) of 0.5 mm and width of 30 mm. The porosity of the blank is greater than the porosity of the final product. During rolling the metal powder is continuously formed.

After leaving the deformation zone, the ribbon-type getter blank is cut into standard sections having lengths of 200 mm, and then the sections are transported into the heating zone. Within the heating zone a pressure of 0.025 Pa is created and maintained, and the blank is heated to the temperature (T) of 850 degrees Celsius, followed by holding during 1 hour. After cooling, the blank is removed. Porosity (P) of the final product is 43%, and its tensile strength is 2.1 kg/mm$^2$.

Resulting getter has a sorption rate (S) with respect to hydrogen of 4.0 m$^3$/m$^2$·s at a sorption temperature (t) of 20 degrees Celsius when the quantity of sorbed hydrogen (Q) is 1.3 m$^3$ Pa/kg after getter activation at the temperature (TaKT) of 350 degrees Celsius during 15 min.

EXAMPLE 2

Metal powder containing 27.20% by weight of vanadium, 0.21% by weight of calcium, 72.61% by weight of titanium, and having bulk density ($\gamma$) of 0.98 g/cm$^3$, is fed into a deformation zone. The metal powder contains 48% (by weight) fraction (q) having particle size less than 50 $\mu$m. Within the deformation zone metal powder is formed by rolling using rollers as described in Example 1. As a result, a getter blank of uniform density is produced in the form of a ribbon having thickness (h) of 0.5 mm and width of 30 mm. The porosity of the blank is greater than the porosity of the final product.

After leaving the deformation zone, the ribbon-type getter blank is cut into standard sections. The standard sections of getter blank having a porosity (P) below 45% are then coiled into coils having an inner diameter of 80 mm. The length of the standard section is 2.96 m.

Coiled getter blank is transported into the heating zone, wherein a pressure of 0.025 Pa is created and maintained. The blank is heated to the temperature (T) of 850 degrees Celsius, followed by holding during 1 hour.

After cooling, the coiled blank is removed. Resulting getter is characterized by a large sorptive surface which is larger than that of the getter as per Example 1. Porosity (P) of the coiled getter is 38.5%. The sorption rate (S) of the coiled getter with respect to hydrogen is 3.3 m$^3$/m$^2$·s at a sorption temperature (t) of 20 degrees Celsius when the quantity (Q) of sorbed hydrogen is 1.3 m$^3$ /Pa/kg after getter activation at the temperature (TaKT) of 350 degrees Celsius during 15 min.

The results of the experiments carried out using metal powder with different bulk densities and applying different sintering temperatures, are provided in the Table.

TABLE

| | Element content (% by weight) | | | $\gamma$ | q | T | P | h | S (m$^3$/m$^2$s at t = 20° C. Q = 1.3 m$^3$Pa/kg TaKT = 350° C. |
|---|---|---|---|---|---|---|---|---|---|
| No. | V | Ca | Ti | (g/cm$^3$) | (%) | (°C.) | (%) | mm | 15 min. |
| 1 | 28.45 | 0.31 | Balance | 1.17 | 57 | 850 | 43 | 0.5 | 4.0 |
| 2 | 27.20 | 0.21 | " | 0.98 | 48 | 850 | 38.5 | 0.5 | 3.3 |
| 3 | 27.20 | 0.21 | " | 1.46 | 68 | 780 | 32 | 0.65 | 2.9 |
| 4 | 27.20 | 0.21 | " | 0.8 | 26 | 900 | 52 | 0.71 | 5.2 |
| 5 | 32.2 | 0.18 | " | 0.77 | 18 | 860 | 54 | 0.68 | 7.3 |

wherein $\gamma$ is bulk density of metal powder;

q is the quantity of the fraction having particle sizes less than 50 $\mu$m;

T is heating temperature;

P is getter porosity;

h is getter thickness;

S is hydrogen sorption rate;

t is sorption temperature;

Q is the quantity of sorbed hydrogen;

TaKT is getter activation temperature.

INDUSTRIAL APPLICABILITY

Getter according to the invention having porosity of 30%, when used as the first stage formed by forty plates having dimensions 180×30×0.8 mm in a multistage magnetic discharge pump mounted in an accelerator used in semiconductors production, has pumping rate with respect to hydrogen from 0.3 to 2 m$^3$/s.

We claim:

1. A nonevaporable getter prepared from a metal powder comprising a titanium-vanadium alloy containing from 20 to 35% by weight of vanadium, from 0.1% to 0.5% by weight of calcium, the balance being titanium, said metal powder having a bulk density in the range from about 0.7 to about 1.5 g/cm$^3$, said getter comprising from 20 to 35% by weight of vanadium, from 0.1 to 0.5% by weight of calcium, the balance being titanium, wherein said getter has a porosity from 25 to 65% by volume.

2. A process for producing nonevaporable getter comprising the following steps:

a. feeding metal powder into a deformation zone, the metal powder comprising a titanium-vanadium alloy containing from 20 to 35% by weight of vanadium, from 0.1% to 0.5% by weight of calcium, the balance being titanium, said metal powder having a bulk density in the range from about 0.7 to about 1.5 g/cm$^3$;

b. forming the metal powder by rolling to produce a getter blank in the form of a ribbon;

c. cutting the ribbon into standard sections after the ribbon leaves the deformation zone;

d. transporting the sections of ribbon into a heating zone, wherein a pressure below 1 Pa is created and maintained;

e. heating the getter blank to a temperature which is lower than 0.6 times the melting point of the titanium-vanadium alloy and within the range from about 750 degrees Celsius to about 950 degrees Celsius;

f. holding said getter blank to produce a getter having porosity from 25% to 65% by volume.

3. A process according to claim 2, characterized by that said metal powder being fed into said deformation zone contains less than 70% by weight of a fraction having particle size less than 50 $\mu$m.

4. A process according to claim 2, wherein said standard section is coiled when the porosity of said getter blank is below 45%.

5. A process according to claim 3, wherein said getter blank is heated to a temperature within the range from about 750 degrees Celsius to about 950 degrees Celsius.

6. A process according to claim 3, wherein said standard section is coiled, when the porosity of said getter blank is below 45%.

* * * * *

UNITED STATES PATENT AND TRADEMARK OFFICE
CERTIFICATE OF CORRECTION

Patent No.: 5,814,241

Dated: September 29, 1998

Inventor(s): Reutova et al.

It is certified that error appears in the above-identified patent and that said Letters Patent is hereby corrected as shown below.

ON THE TITLE PAGE,

Item [73], change "Tekhnovakt" to -Tekhnovak+--.

Signed and Sealed this

Eleventh Day of May, 1999

*Attest:*

*Attesting Officer*

Q. TODD DICKINSON

*Acting Commissioner of Patents and Trademarks*